US006729919B2

(12) United States Patent
Kitsu et al.

(10) Patent No.: US 6,729,919 B2
(45) Date of Patent: May 4, 2004

(54) STEERING HANDLE DEVICE FOR OUTBOARD ENGINE SYSTEM

(75) Inventors: Kunihiro Kitsu, Saitama (JP); Kouichi Oka, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/351,573

(22) Filed: Jan. 27, 2003

(65) Prior Publication Data

US 2003/0176121 A1 Sep. 18, 2003

(30) Foreign Application Priority Data

Jan. 29, 2002 (JP) ..... 2002-020223

(51) Int. Cl.[7] ..... B63H 20/08
(52) U.S. Cl. ..... 440/53; 440/63; 440/87
(58) Field of Search ..... 440/53, 63, 83, 440/87

(56) References Cited

U.S. PATENT DOCUMENTS 5,797,777 A * 8/1998 Tsunekawa et al. ..... 440/84

FOREIGN PATENT DOCUMENTS

JP 10250688 A * 9/1998 ..... B63H/20/00
JP 2913228 4/1999

* cited by examiner

*Primary Examiner*—Jesus D. Sotelo
(74) *Attorney, Agent, or Firm*—Arent Fox PLLC

(57) ABSTRACT

In a steering handle device including a tilting switch, an overhang portion is formed on a switch case detachably secured to a lower surface of a steering handle, and protrudes from a side of the steering handle toward a side where a steersman is in position. A tilting switch is mounted in a switch-mounting bore which is open at a rear slant wall of the overhang portion. Thus, the steering handle can be also used commonly in an outboard engine system including no tilting switch.

5 Claims, 7 Drawing Sheets

STEERING HANDLE DEVICE FOR OUTBOARD ENGINE SYSTEM

BACKGROUND OF THE INVENTION

1. Field of the Invention

The present invention relates to an improvement in a steering handle device for an outboard engine system, including a steering handle connected to a handle holder in the outboard engine system and provided at its tip end with a throttle grip, and a tilting switch disposed on the steering handle in the vicinity of the throttle grip and designed for operating a tilting device for tilting up and down the outboard engine system.

2. Description of the Related Art

A conventional steering handle device for an outboard engine system is already known, as disclosed in, for example, Japanese Patent No. 2,913,228.

In the conventional steering handle device for the outboard engine system, a tilting switch is mounted on a switch-mounting portion integrally formed on a steering handle.

Some types of outboard engine systems include a tilting switch to be mounted in a steering handle, and the other types do not include any. Therefore, outboard engine system manufacturing factories conventionally prepare at least two types of steering handles in accordance with the presence or absence of the tilting switch. This obstructs a reduction in cost.

SUMMARY OF THE INVENTION

Accordingly, it is an object of the present invention to provide a steering handle device for an outboard engine system, wherein a steering handle can be also used commonly in an outboard engine system having no tilting switch, to thereby contribute to a reduction in cost.

To achieve the above object, according to a first feature of the present invention, there is provided a steering handle device for an outboard engine system, comprising a steering handle connected to a handle holder in the outboard engine system and provided at its tip end with a throttle grip, and a tilting switch disposed on the steering handle in the vicinity of the throttle grip and designed for operating a tilting device for tilting up and down the outboard engine system, wherein an overhang portion is formed on a switch case detachably secured to a lower surface of the steering handle and protrudes from a side of the steering handle toward side where a steersman is in position, and the tilting switch is mounted in a switch-mounting bore which is open at an outer surface of the overhang portion.

The switch-mounting bore corresponds to a first witch-mounting bore 30 in an embodiment of the present invention, which will be hereinafter described.

With the first feature, the tilting switch is mounted at the overhang portion of the switch case, the overhang portion protruding from the side of the steering handle toward the steersman, leading to a good visual recognition and a good operability.

Moreover, the switch case is attachable to and detachable from the lower surface of the steering handle, and hence the steering handle with the switch case removed therefrom can be also used in an outboard engine system including no tilting switch, without harming the appearance of the outboard engine system. Therefore, the steering handle can be used commonly in both the outboard engine system including the tilting switch and the outboard engine system including no tilting switch, to thereby contribute to a reduction in cost.

According to a second feature of the present invention, in addition to the first feature, the tilting switch includes an operating element which faces an opening in the switch-mounting bore and which comprises a tilting-up upper urging portion for operating the tilting device in a tilting-up direction and a tilting-down lower urging portion for operating the tilting device in a tilting-down direction, the tilting-up/down urging portions being disposed vertically.

With the second feature, the direction of the tilting-up operation of the tilting device corresponds to the tilting-up upper urging portion of the operating element, and the direction of the tilting-down operation of the tilting device corresponds to the tilting-down upper urging portion of the operating element, whereby the mis-operation of the tilting switch can be prevented.

According to a third feature of the present invention, in addition to the first or second feature, the switch-mounting bore is open at a rear slant wall of the overhang portion of the switch case, the rear slant wall facing obliquely rearward.

With the third feature, a steersman, while grasping the throttle grip by his one hand, can urge the operating element naturally by the other hand, leading to a further enhanced operability of the tilting switch.

According to a fourth feature of the present invention, in addition to the first or second feature, the tilting switch is disposed so that the operating element thereof is sunk below the outer surface of the overhang portion, and a recess for receiving a finger of the steersman who operates the operating element is defined in the outer surface of the overhang portion.

With the fourth feature, the steersman can easily operate the tilting switch by putting his finger into the recess, while it is usually possible to avoid the contact between the other objects and the operating element of the tilting switch which is sunk below the outer surface of the overhang portion of the switch case.

According to a fifth feature of the present invention, in addition to the first or second feature, an engine starter switch is mounted in a second switch-mounting bore defined in a rear end wall of the switch case immediately below the steering handle.

The second switch-mounting bore corresponds to a second switch-mounting bore 32 of the present invention, which will be hereinafter described.

With the fifth feature, the starter switch is hidden in the lower portion of the steering handle, and thus the mis-operation of the starter switch due to the contact with the other objects can be prevented.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of a preferred embodiment with reference to the accompanying drawings.

The terms "front and rear" and "left and right" in the following description are referred to with respect to a boat to which an outboard engine system 1 is mounted.

Figure 1:
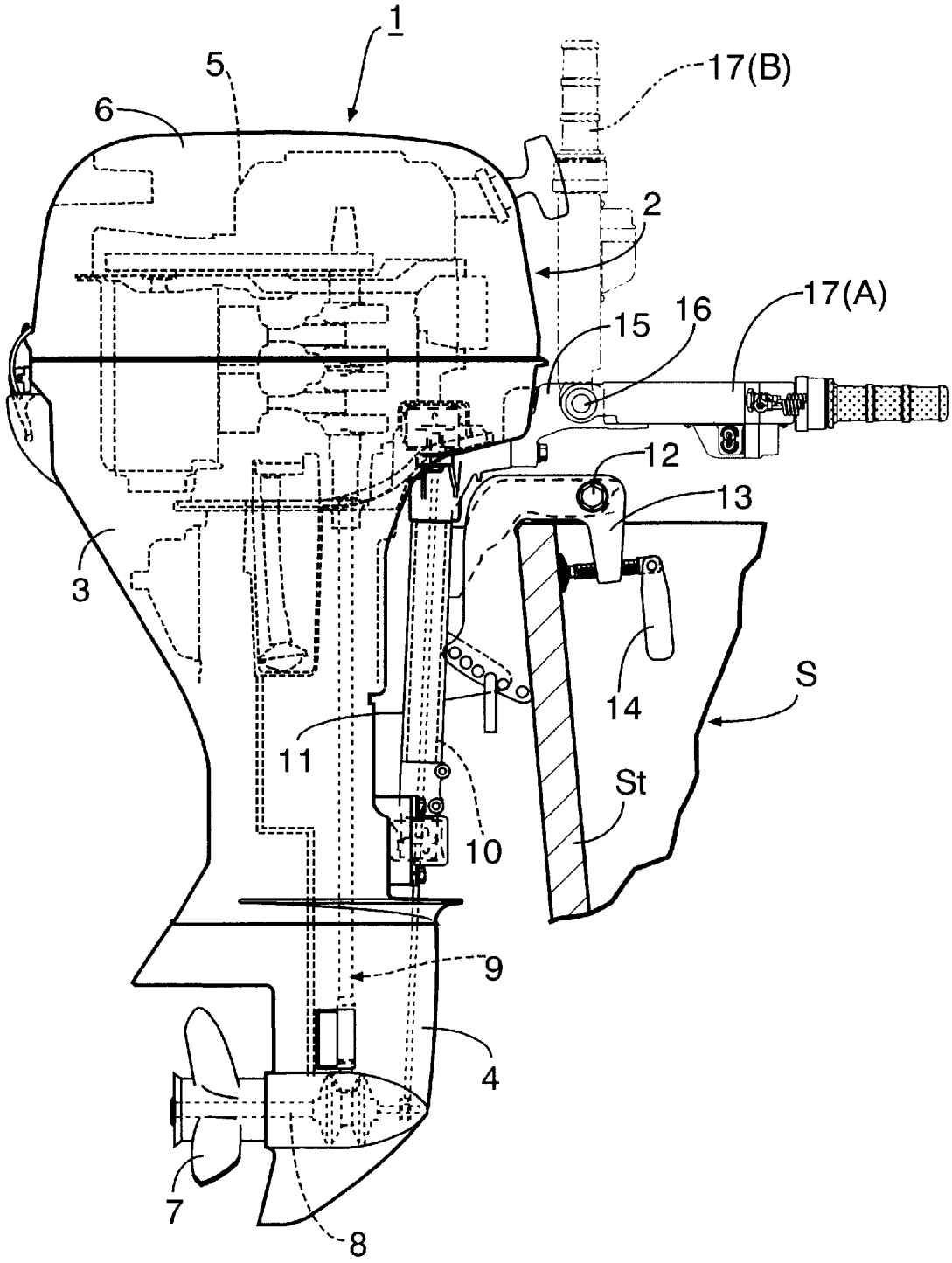
FIG. 1 is a side view of an outboard engine system including a steering handle device according to the present invention.

Referring first to FIG. 1, the outboard engine system 1 includes, as an outboard engine system body, an extension case 3, a gear case 4 coupled to a lower end face of the extension case 3, an engine 5 mounted at an upper portion of the extension case 3, an engine hood 6 coupled to the extension case 3 to cover the engine 5. A propeller shaft 8 having a propeller 7 mounted at its outer end is carried in the gear case 4. A transmitting device 9 for transmitting an output from the engine 5 to the propeller shaft 8 is disposed within the extension case 3 and the gear case 4.

A swivel case 11 is relatively turnably connected to a front portion of the extension case 3 through a swivel shaft 10 extending vertically. A stern bracket 13 is relatively turnably connected to the swivel case 11 through a tilting shaft 12 extending vertically. The stern bracket 13 is fixed to a transom St of the boat S by a clamping means 14. As a result, the outboard engine system body 2 is capable of steering the boat S by the laterally turning movement about the swivel shaft 10, and being tilted up or tilted down by the vertically turning movement about the tilting shaft 12. A known electric hydraulic tilting device (not shown) for tilting up and down the outboard engine system body 2 is mounted between the outboard engine system body 2 and the swivel case 11.

Figure 2:
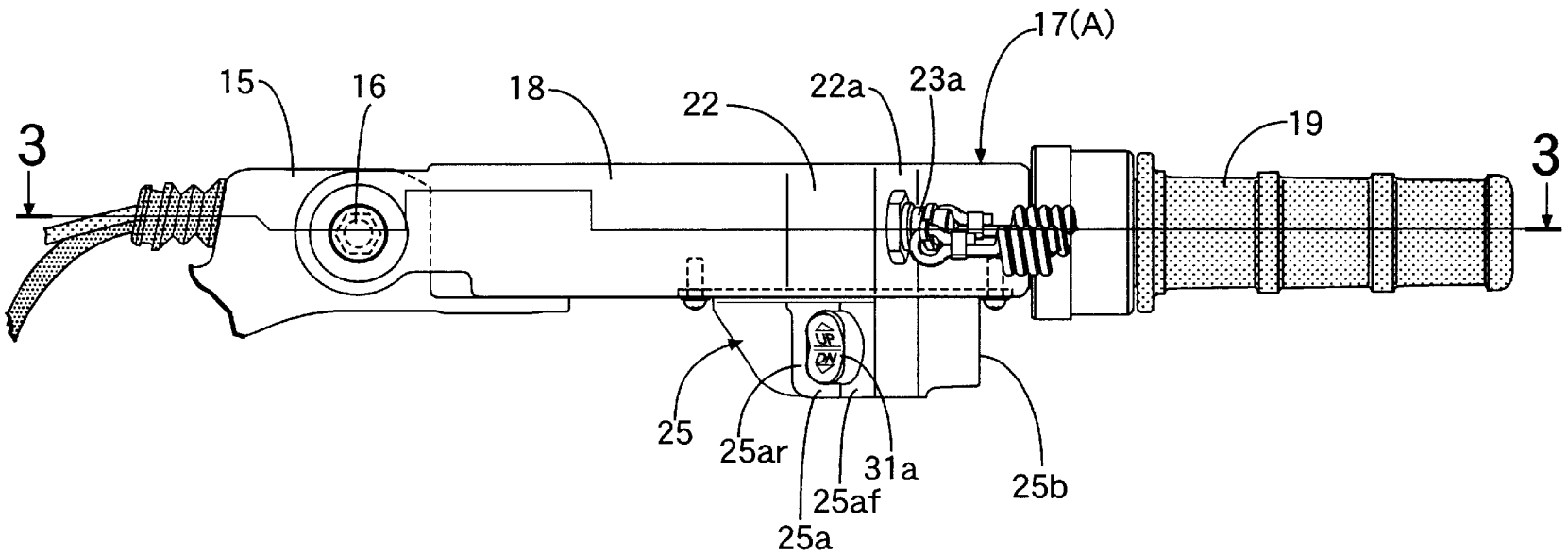
FIG. 2 is an enlarged side view of the steering handle device.

As shown in FIGS. 1 and 2, a handle holder 15 is secured to a front surface of an upper portion of the outboard engine system body 2 by a bolt. A bar-shaped steering handle 17 is mounted to the handle holder 15 through a pivot 16 extending laterally. The steering handle 17 is capable of turning between an operating position A in which it is fallen forwards of the pivot 16 to be substantially horizontal, and a retracted position B in which it is upright on the pivot.

Figure 3:
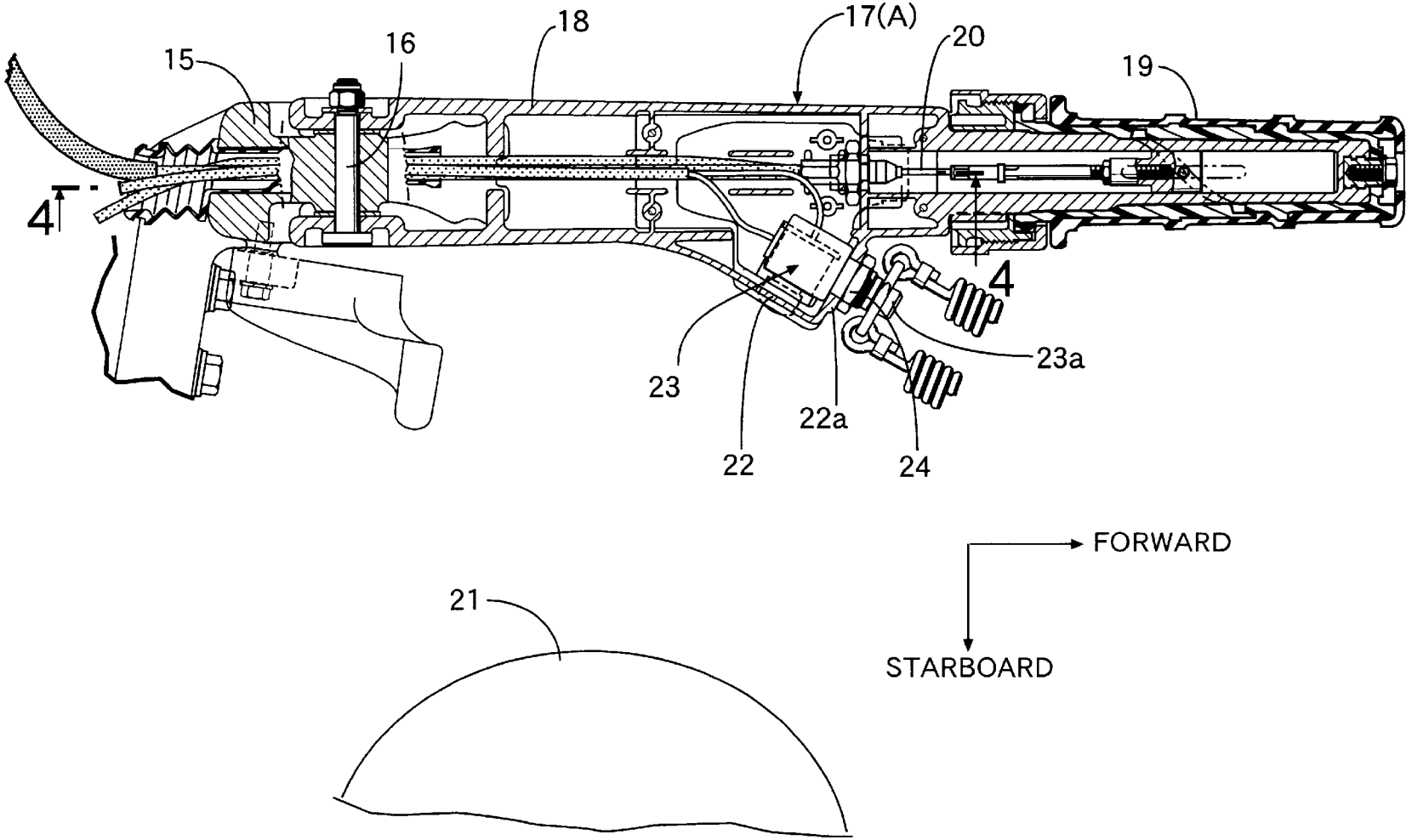
FIG. 3 is a sectional view taken along a line 3—3 in FIG. 2.
Figure 4:
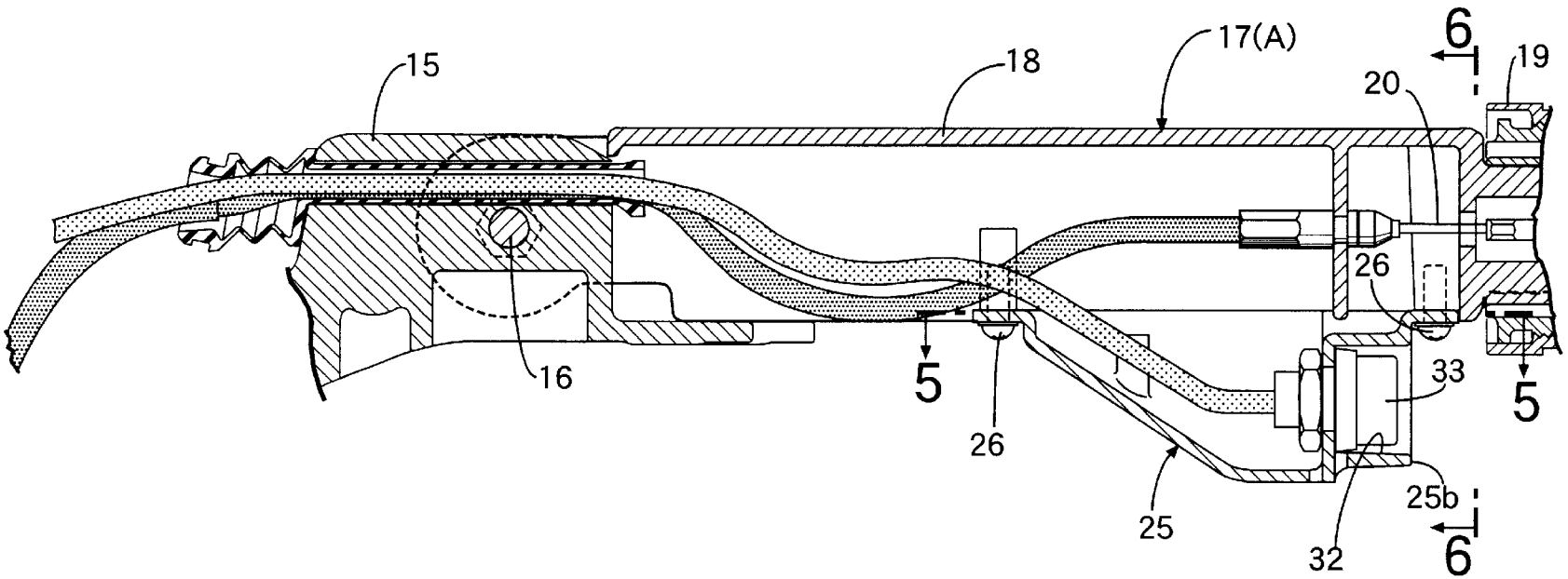
FIG. 4 is a sectional view taken along a line 4—4 in FIG. 3.

Referring to FIGS. 3 and 4, the steering handle 17 comprises a handle body 18 made of a synthetic resin or a light alloy and supported on the pivot 16, and a throttle grip 19 rotatably fitted over an outer periphery of a tip end of the handle body 18. The throttle grip 19 is connected to a throttle valve (not shown) of the engine 5 through a throttle cable 20 disposed within the handle body 18 so that the throttle valve is opened and closed by the rotation of the throttle grip 19.

A switch-mounting portion 22 (see FIG. 6) bulged into a chevron shape is integrally formed on laterally one sidewall of the handle body 18 (usually, a right sidewall in correspondence to a steersman 21 occupying a position on a starboard of the boat S in the illustrated embodiment) in the vicinity of a base portion of the throttle grip 19. An engine-killing switch 23 is mounted to an obliquely rearward facing rear slant wall 22*a* of the switch-mounting portion 22 by a nut 24. The engine-killing switch 23 is adapted to bring an ignition device for the engine 5 into an inoperative state by pulling an operating element 23*a* thereof, to thereby forcibly stop the operation of the engine 5.

Figure 5:
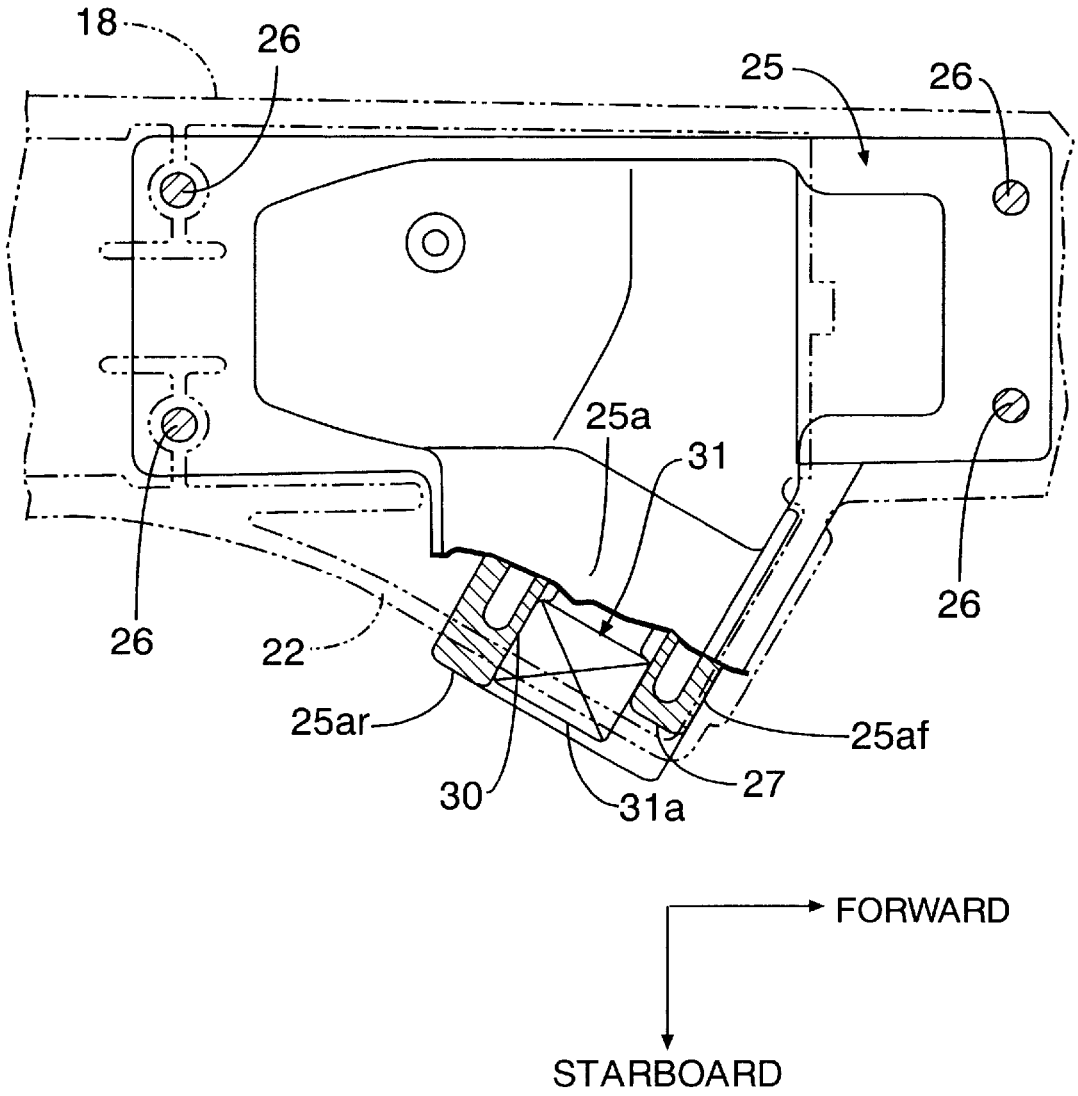
FIG. 5 is a sectional view taken along a line 5—5 in FIG. 4.

As shown in FIGS. 4 and 5, the handle body 18 has an angular U-shaped section with a lower surface opened, excluding a base end supported on the pivot 16 and a tip end over which the throttle grip 19 is fitted. A switch case 25 made of a synthetic resin is detachably secured to the lower surface of the handle body 18 by a plurality of screws 26.

The switch case 25 is formed with an overhang portion 25*a*, which protrudes from one sidewall of the handle body 18 toward the right board of the boat S so that it is overlapped on a lower portion of the switch-mounting portion 22. The overhang portion 25*a* comprises an obliquely forward facing front slant wall 25*af* and an obliquely rearward facing rear slant wall 25*ar*. A first switch-mounting bore 30 is defined in the overhang portion 25*a* to be open at the rear slant wall 25*ar*. A tilting switch 31 for controlling the tilting device is mounted in the first switch-mounting bore 30.

Figure 6:
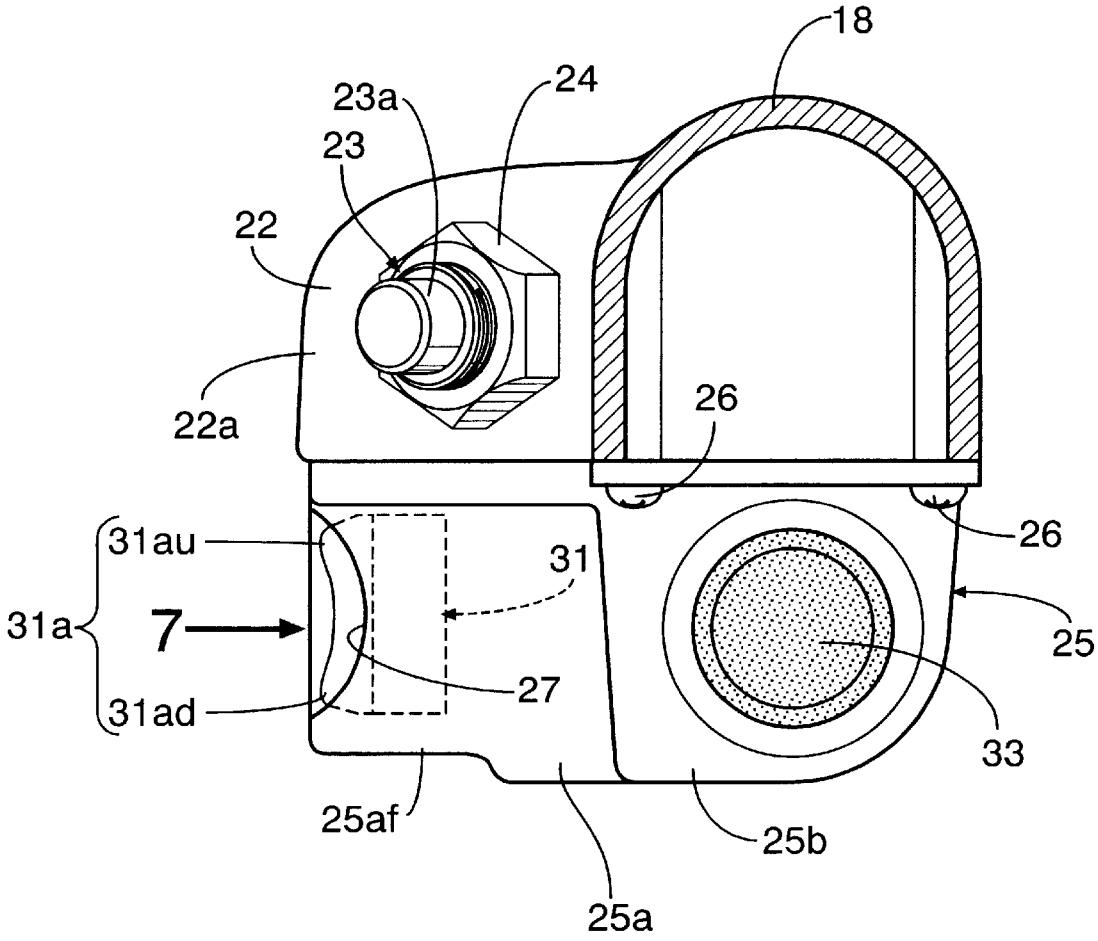
FIG. 6 is a sectional view taken along a line 6—6 in FIG. 4.
Figure 7:
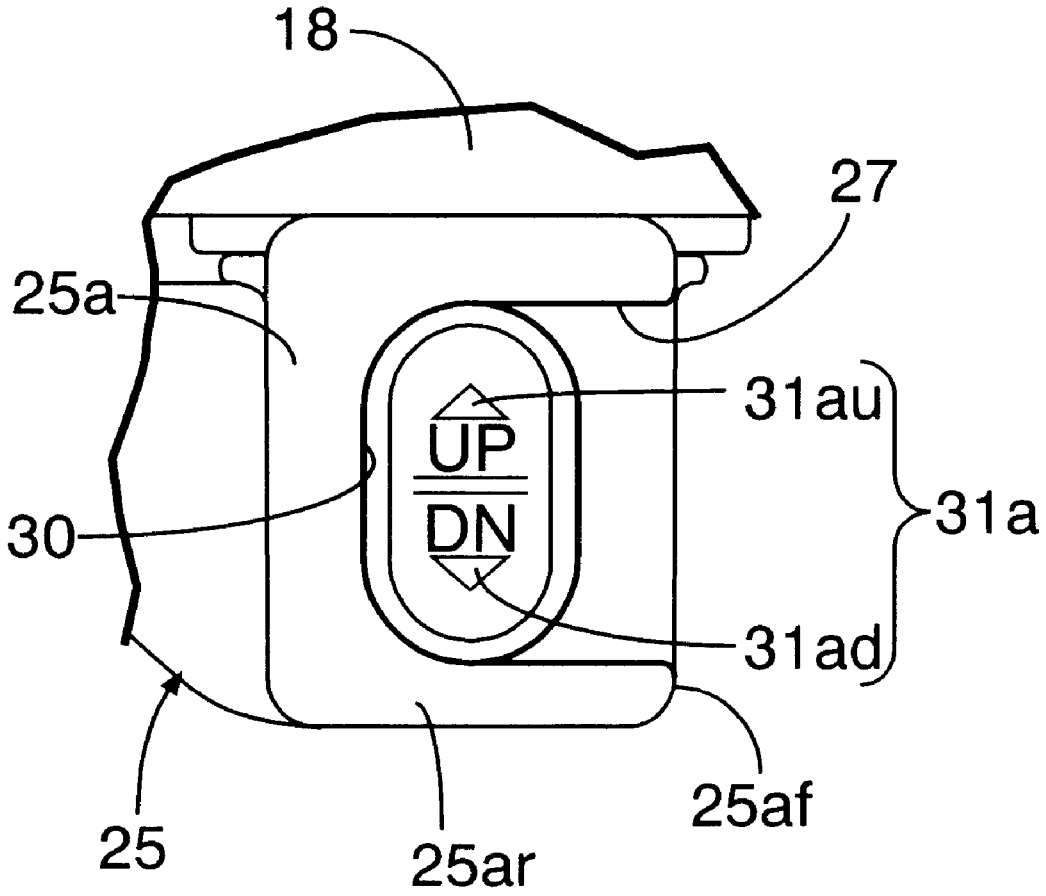
FIG. 7 is a view taken in a direction of an arrow 7 in FIG. 6.

As shown in FIGS. 6 and 7, the tilting switch 31 has an operating element 31*a* which faces to an opening in the first switch-mounting bore 30 and which includes a tilting-up upper urging portion 31*au* for operating the tilting device into a tilted-up position, and a tilting-down lower urging portion 31*ad* for operating the tilting device to a tilted-down position. The tilting-up upper urging portion 31*au* and the tilting-down lower urging portion 31*ad* are disposed vertically. That is, the operating element 31*a* is constructed into a seesaw type. When the operating element 31*a* is in a non-operated free state, it is retained in its neutral position to keep the tilting switch 31 in a turned-off state.

The tilting switch 31 is disposed so that the operating element 31*a* is sunk below the rear slant wall 25*ar*, and thus the other objects are prevented from accidentally contacting the operating element 31*a*. A recess 27 for receiving a finger of an operator who operates the operating element 31*a*, is provided in the rear slant wall 25*ar* to extend from a front edge of the rear slant wall 25*ar* to the first switch-mounting bore 30.

As shown in FIGS. 4 and 7, a second switch-mounting bore 32 is also provided in the switch case 25, and open at a front end wall 25*b* located immediately below the handle body 18. An engine starter switch 33 is mounted in the second switch-mounting bore 32. The starter switch 33 is disposed so that its operating portion is sunk below the front end wall 25*b*, and thus the other objects are prevented from accidentally contacting the operating portion.

The operation of this embodiment will be described below.

The steersman 21 of the boat S usually occupies a position displaced from the steering handle 17 toward the starboard of the boast S, and grasps the throttle grip 19 by his left hand to swing the steering handle 18 laterally for the steering, while adjusting the rotational speed of the engine of the outboard engine system 1, i.e., the rotational speed of the propeller 7 by changing the rotational angle of the steering handle 17.

In cruising in a shoal, if the steersman pushes the tilting-up upper urging portion 31*au* of the operating element 31*a* of the tilting switch 31 by a thumb of his right hand while grasping the throttle grip 19 by his left hand, the tilting device (not shown) can be operated in a tilting-up direction to tilt up the outboard engine system body 2, thereby avoiding the contact between the propeller 7 and the bottom. If the finger is released from the tilting-up upper urging portion 31*au*, the operating element 31*a* is automatically restored to the neutral position to bring the tilting switch 31 into the turned-off state, so that the tilting device can be stopped to retain the outboard engine system body 2 in the tilted-up state.

After passing the shoal, if the tilting-down lower urging portion 31*ad* of the operating element 31*a* of the tilting switch 31 is pushed, the tilting device is operated in a tilting-down direction to tilt down the outboard engine system body 2, thereby lowering the propeller 7 down to a desired position. Also in this case, if the finger is released from the tilting-down lower urging portion 31*ad*, the operating element 31*a* is automatically restored to the neutral position to bring the tilting switch 31 into the turned-off state, so that the tilting device can be stopped to retain the outboard engine system body 2 in the tilted-down state.

In this way, the direction of the tilting-up operation of the tilting device corresponds to the tilting-up upper urging portion 31*au* of the operating element 31*a*, and the direction of the tilting-down operation of the tilting device corresponds to the tilting-down lower urging portion 31*ad* of the operating element 31*a*, and hence the mis-operation of the tilting switch 31 can be prevented.

The tilting switch 31 is mounted on the overhang portion 25*a* of the switch case 25, the overhang portion 25*a* protruding from the outer side of the steering handle 17 toward the steersman 21, leading to a good visual recognition and a good operability.

The tilting switch 31 is in a rational arrangement in accordance with the ergonomics such that the steersman 21 can naturally urge the operating element 31*a* by the thumb of his right hand while grasping the throttle grip 19 by his left hand, because particularly the operating element 31*a* is mounted to face the obliquely rearward facing rear slant wall 25*ar* of the overhang portion 25*a*.

Further, the operating element 31*a* of the tilting switch 31 is sunk below the rear slant wall 25*ar*, so that the contact between the operating element 31*a* and the other objects is usually avoided. However, the recess 27 for receiving the thumb of the steersman 21 is defined in the rear slant wall 25*ar*, and hence it is possible to easily conduct the operation of the operating element 31*a* by the thumb.

The engine starter switch 33 is mounted on the front end wall 25*b* of the switch case 25, and hence the steersman 21 can easily urge the starter switch 33 by his right hand while grasping the throttle grip 19 by his left hand 19. Moreover, the starter switch 33 is hidden in the lower portion of the steering handle 17, and hence the mis-operation of the starter switch 33 due to the contact with the other objects can be prevented.

The switch case 25 with the tilting switch 31 and the starter switch 33 mounted thereto is detachably secured to the lower surface of the steering handle 17 by the screws 26. Therefore, even when the outboard engine system 1 is not provided with the tilting switch 31 and the starter switch 33, the steering handle 17 with the switch case 25 removed therefrom can be used as it is in such an outboard engine system. Therefore, the steering handle 17 can be used commonly in the outboard engine system provided with the tilting switch 31 and the starter switch 33 as well as in the outboard engine system not provided with such components, so that it is unnecessary to prepare different steering handles depending on the type of the outboard engine system, which can contribute to a reduction in cost.

The present invention is not limited to the above-described embodiment, and various modifications in design may be made without departing from the spirit and scope of the invention defined in the claims.

What is claimed is:

1. A steering handle device for an outboard engine system, comprising a steering handle connected to a handle holder in the outboard engine system and provided at its tip end with a throttle grip, and a tilting switch disposed on said steering handle in the vicinity of said throttle grip and designed for operating a tilting device for tilting up and down the outboard engine system, wherein an overhang portion is formed on a switch case detachably secured to a lower surface of said steering handle and protrudes from a side of said steering handle toward a side where a steersman is in position, and said tilting switch is mounted in a switch-mounting bore which is open at an outer surface of said overhang portion, wherein said switch-mounting bore is open at a rear slant wall of said overhang portion of said switch case, the rear slant wall facing obliquely rearward.

2. A steering handle device for an outboard engine system according to claim 1, wherein said tilting switch includes an operating element which faces an opening in said switch-mounting bore and which comprises a tilting-up upper urging portion for operating the tilting device in a tilting-up direction and a tilting-down lower urging portion for operating the tilting device in a tilting-down direction, said tilting-up/down urging portions being disposed vertically.

3. A steering handle device for an outboard engine system according to claim 1, wherein said tilting switch is disposed so that said operating element thereof is sunk below the outer surface of said overhang portion, and a recess for receiving a finger of the steersman who operates said operating element is defined in the outer surface of said overhang portion.

4. A steering handle device for an outboard engine system comprising a steering handle connected to a handle holder in the outboard engine system and provided at its tip end with a throttle grip, and a tilting switch disposed on said steering handle in the vicinity of said throttle grip and designed for operating a tilting device for tilting up and down the outboard engine system, wherein an overhang portion is formed on a switch case detachably secured to a lower surface of said steering handle and protrudes from a side of said steering handle toward a side where a steersman is in position, and said tilting switch is mounted in a switch-mounting bore which is open at an outer surface of said overhang portion, wherein said tilting switch is disposed so that said operating element thereof is sunk below the outer surface of said overhang portion, and a recess for receiving a finger of the steersman who operates said operating element is defined in the outer surface of said overhang portion.

5. A steering handle device for an outboard engine system comprising a steering handle connected to a handle holder in the outboard engine system and provided at its tip end with a throttle grip, and a tilting switch disposed on said steering handle in the vicinity of said throttle grip and designed for operating a tilting device for tilting up and down the outboard engine system, wherein an overhang portion is formed on a switch case detachably secured to a lower surface of said steering handle and protrudes from a side of said steering handle toward a side where a steersman is in position, and said tilting switch is mounted in a switch-mounting bore which is open at an outer surface of said overhang portion, wherein an engine starter switch is mounted in a second switch-mounting bore defined in a rear end wall of said switch case immediately below said steering handle.

* * * * *